US011725847B2

(12) United States Patent
Sada et al.

(10) Patent No.: US 11,725,847 B2
(45) Date of Patent: Aug. 15, 2023

(54) DEVICES FOR SUPPORTING EQUIPMENT OUTDOORS AND METHODS OF MANUFACTURE AND USE THEREOF

(71) Applicant: DiversiTech Corporation, Duluth, GA (US)

(72) Inventors: Jonathan M. Sada, Lawrenceville, GA (US); David J. Oriatti, Sugar Hill, GA (US)

(73) Assignee: DiversiTech Corporation, Duluth, GA (US)

( * ) Notice: Subject to any disclaimer, the term of this patent is extended or adjusted under 35 U.S.C. 154(b) by 100 days.

(21) Appl. No.: 17/196,605

(22) Filed: Mar. 9, 2021

(65) Prior Publication Data

US 2022/0057108 A1 Feb. 24, 2022

Related U.S. Application Data

(60) Provisional application No. 62/987,300, filed on Mar. 9, 2020.

(51) Int. Cl.

| | |
|---|---|
| ***F24F 1/60*** | (2011.01) |
| ***F24F 13/32*** | (2006.01) |
| ***F16M 11/20*** | (2006.01) |
| ***F16M 11/22*** | (2006.01) |

(52) U.S. Cl.

CPC ..... *F24F 13/32* (2013.01)

(58) Field of Classification Search

CPC . F16M 11/20; F16M 11/22; F24F 1/60; F24F 13/32; F24F 13/30; Y01T 403/7079; Y01T 403/7083

USPC ..... 165/67, 68, 297

See application file for complete search history.

(56) References Cited

U.S. PATENT DOCUMENTS

| | | | | |
|---|---|---|---|---|
| 4,989,826 | A | 2/1991 | Johnston, Jr. | |
| 5,067,685 | A | 11/1991 | Johnston, Jr. | |
| 5,308,037 | A | 5/1994 | Gonzalez | |
| 5,820,092 | A * | 10/1998 | Thaler | F24F 13/32 248/676 |
| 6,047,935 | A * | 4/2000 | Wright | F24F 13/32 248/237 |
| 6,095,533 | A * | 8/2000 | Balolia | B60T 1/14 188/19 |

(Continued)

FOREIGN PATENT DOCUMENTS

CN 104323625 B 4/2017

OTHER PUBLICATIONS

AC Pro, Adjustable roof curb for package units, condensers, evaporative coolers adjusts from 22" to 68.5", https://store.acpro.com/universal-curb-rc-102-adjustable-roof-curb-black-68-5-x-22-33914, downloaded from internet Jul. 16, 2019 (3 pages).

(Continued)

*Primary Examiner* — Frantz F Jules
*Assistant Examiner* — Jason N Thompson
(74) *Attorney, Agent, or Firm* — Dentons US LLP

(57) ABSTRACT

A device comprises: a plurality of tubular members; a plurality of nodes configured to be assembled with the tubular members and thereby form a frame configured to support an outdoor equipment item thereon; and a plurality of augers configured to be driven through the nodes into a ground such that the frame is secured to the ground when the frame supports the outdoor equipment item.

45 Claims, 4 Drawing Sheets

(56) References Cited

U.S. PATENT DOCUMENTS

| | | | | |
|---|---|---|---|---|
| 6,457,692 | B1 * | 10/2002 | Gohl, Jr. | F24F 13/32 248/301 |
| 6,655,648 | B2 * | 12/2003 | Harris | E02D 27/14 248/156 |
| 7,309,051 | B2 * | 12/2007 | McNeill | A47B 9/14 108/147.11 |
| D600,482 | S | 9/2009 | St. John | |
| D621,634 | S | 8/2010 | Smith et al. | |
| D624,770 | S | 10/2010 | St. John | |
| D634,956 | S | 3/2011 | St. John | |
| 8,348,071 | B1 | 1/2013 | Janlert | |
| D690,073 | S | 9/2013 | Murphy | |
| 8,701,261 | B2 | 4/2014 | Crowley | |
| 8,827,232 | B2 | 9/2014 | Crowley | |
| 9,010,553 | B2 | 4/2015 | Crowley | |
| 9,052,120 | B2 | 6/2015 | Villar | |
| 9,185,971 | B2 | 11/2015 | Crowley | |
| 9,226,575 | B2 * | 1/2016 | Crowley | A47B 43/003 |
| 9,228,756 | B2 | 1/2016 | Crowley | |
| 9,364,093 | B2 | 6/2016 | Williams et al. | |
| D779,868 | S | 2/2017 | Zhu | |
| 10,743,680 | B1 * | 8/2020 | Weis | A47F 5/14 |
| 2007/0144572 | A1 | 6/2007 | Patel et al. | |
| 2013/0306808 | A1 * | 11/2013 | Huang | A47B 13/06 248/163.1 |
| 2014/0075980 | A1 * | 3/2014 | Villar | F24F 13/32 62/297 |
| 2017/0197554 | A1 * | 7/2017 | Rouleau | B60R 9/0485 |
| 2017/0370601 | A1 * | 12/2017 | Glenn | F24F 7/025 |

OTHER PUBLICATIONS

Dandon Angling, Matrix quad pole roller, https://dansononline.co.uk/product/matrix-quad-pole-roller/, downloaded from internet Jul. 16, 2019 (3 pages).

Todber Manor, Colmic folding pro platform, https://todbermanor.co.uk/colmic-/7193-colmic-folding-pro-platform.html, downloaded from internet Jul. 16, 2019 (2 pages).

* cited by examiner

DEVICES FOR SUPPORTING EQUIPMENT OUTDOORS AND METHODS OF MANUFACTURE AND USE THEREOF

CROSS-REFERENCE TO RELATED PATENT APPLICATION

This patent application claims a benefit of U.S. Provisional Patent Application 62/987,300 filed 9 Mar. 2020, which is incorporated by reference herein for all purposes.

BACKGROUND

A heating, ventilation, and air conditioning (HVAC) system may have a condenser unit positioned outdoors. The condenser unit can rest on a pad laying on a ground surface in order to keep the condenser unit raised above the ground surface for efficient operation and safety purposes.

In high velocity wind zones (e.g., Florida), there are various legal requirements (e.g., building code) that govern how the condenser unit can rest on the pad. For example, one of such requirements is that the condenser unit be raised a certain distance above the ground surface. Another of such requirements is that the condenser unit, when anchored to the pad, must be able to resist various overturn forces that are generated by high winds (e.g., a hurricane). Usually, this overturn resistance is achieved through weight. As such, the pad can be entirely constructed out of concrete, which is heavy. Alternatively, the pad can have a shell constructed out of concrete and a foam core positioned within the shell in order to make the pad less heavy for transit, since solid concrete may make the pad heavier than necessary to comply with the legal requirements that govern how the condenser unit can rest on the pad.

When the pad is constructed, one conventional solution involves having a concrete slab being poured in place at an installation site. However, this approach is not desirable because building up the concrete slab is time-consuming and laborious. Additionally, this approach is not desirable because the concrete slab must adequately cure, which delays installation of the condenser unit. If the concrete slab is constructed offsite, then the concrete slab can crack in transit to the installation site. Further, even if the concrete slab has the foam core, then the concrete slab is cumbersome to handle due to size and weight.

SUMMARY

Generally, this disclosure enables various devices for supporting various indoor or outdoor equipment items, which can be of different sizes or shapes or positioned indoors or outdoors. For example, some of such equipment items can include various electrical equipment (e.g., electrical transformers, stand-by electrical generators, water pumps) configured for placement outdoors, which can be in high velocity wind zones or non-high velocity wind zones. For example, some of such equipment items can include various HVAC condenser units configured for placement outdoors, which can be in high velocity wind zones or non-high velocity wind zones. For example, some of such devices can include a support stand where a plurality of tubular members can be utilized with a plurality of connection nodes that can allow the support stand to be easily assembled, but only require a small shipping box (or another shipping form factor). The support stand can have an overturn resistance that can be achieved with a set of ground anchors or augers that can be driven into a ground with a standard socket and wrench or a power tool (e.g., an electric drill, an electric impact driver). Each side of the support stand can have a tube-within-tube construction that can allow the support stand to be adjusted to fit a number of different sized or shaped condenser units (or other equipment items). These components can be disassembled to fit in a small shipping package (or another shipping form factor) and be lightweight.

In an embodiment, a device comprises: a plurality of tubular members; a plurality of nodes configured to be assembled with the tubular members and thereby form a frame configured to support an outdoor equipment item thereon; and a plurality of augers configured to be driven through the nodes into a ground such that the frame is secured to the ground when the frame supports the outdoor equipment item.

In an embodiment, a method comprises: causing a plurality of tubular members and a plurality of nodes to be assembled into a frame; causing a plurality of augers to be driven through the nodes into a ground as the frame rests on the ground such that the frame is secured to the ground; and causing an outdoor equipment item to be positioned on the frame after the frame is secured to the ground such that the frame extends between the outdoor equipment item and the ground.

In an embodiment, a kit comprises: a container; a plurality of tubular members contained in the container; a plurality of nodes contained in the container, wherein the nodes are configured to be assembled with the tubular members and thereby form a frame configured to support an outdoor equipment item thereon; a plurality of augers contained in the container, wherein the augers are configured to be driven through the nodes into a ground such that the frame is secured to the ground when the frame (a) supports the outdoor equipment item and (b) extends between the outdoor equipment item and the ground; and a plurality of brackets contained in the container, wherein the brackets are configured to grasp the frame and to be fastened to the outdoor equipment item above the frame when the frame (a) supports the outdoor equipment item and (b) extends between the outdoor equipment item and the ground.

In an embodiment, a method comprises: causing a first auger to be driven through a frame into a ground such that the frame (a) rests on the ground and (b) is secured to the ground via the first auger; causing a second auger to be driven through the frame into the ground such that the frame (a) is raised over the ground thereby forming an air gap between the frame and the ground and (b) is secured to the ground via the second auger; and causing an equipment item to be positioned on the frame such that the frame extends (a) between the equipment item and the ground and (b) between the equipment item and the air gap.

DETAILED DESCRIPTION

Figure 1:
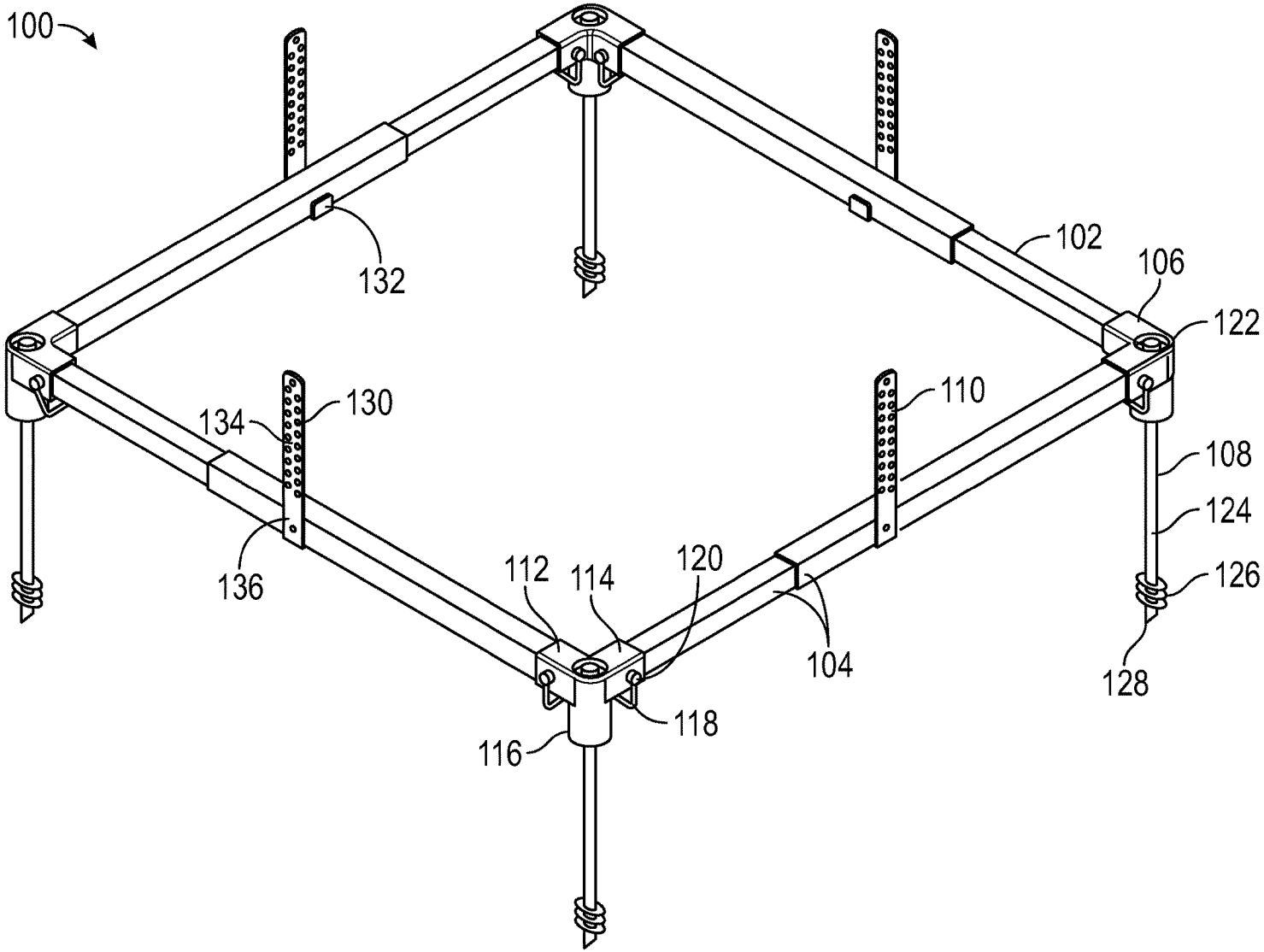
FIG. 1 shows an embodiment of a device for supporting an equipment item according to this disclosure.

Generally, this disclosure enables various devices for supporting various indoor or outdoor equipment items, which can be of different sizes or shapes or positioned indoors or outdoors. For example, some of such equipment items can include various electrical equipment (e.g., electrical transformers, stand-by electrical generators, water pumps) configured for placement outdoors, which can be in high velocity wind zones or non-high velocity wind zones. For example, some of such equipment items can include various HVAC condenser units configured for placement outdoors, which can be in high velocity wind zones or non-high velocity wind zones. For example, some of such devices can include a support stand where a plurality of tubular members can be utilized with a plurality of connection nodes that can allow the support stand to be easily assembled, but only require a small shipping box (or another shipping form factor). The support stand can have an overturn resistance that can be achieved with a set of ground anchors or augers that can be driven into a ground with a standard socket and wrench or a power tool (e.g., an electric drill, an electric impact driver). Each side of the support stand can have a tube-within-tube construction that can allow the support stand to be adjusted to fit a number of different sized or shaped condenser units (or other equipment items). These components can be disassembled to fit in a small shipping package (or another shipping form factor) and be lightweight. However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

As used herein, various singular forms "a," "an" and "the" are intended to include various plural forms as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

As used herein, unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized or overly formal sense unless expressly so defined herein.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

Features described with respect to certain embodiments may be combined in or with various some embodiments in any permutational or combinatory manner. Different aspects or elements of example embodiments, as disclosed herein, may be combined in a similar manner.

Although various terms first, second, third, and so forth can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

FIG. 1 shows an embodiment of a device for supporting an equipment item according to this disclosure. In particular, a device 100 includes a frame 102, a plurality of augers 108, and a plurality of brackets 110. The device 100 can be used to support, whether indoors or outdoors, an equipment item, whether an indoor equipment item or an outdoor equipment item. For example, the equipment item can be an electrical transformer configured for an outdoor use, an HVAC condenser unit configured for an outdoor use, a stand-by electric generator configured for an outdoor use, a water pump configured for an outdoor use, or others. Note that the outdoor use may include a situation when the device 100 is covered (e.g., within a tent or a greenhouse or covered by an umbrella or a canopy or a soffit) or a situation when the device 100 is uncovered (e.g., exposed to sky).

The frame 102 includes a plurality of tubular members 104 (whether internally hollow or internally solid) and a plurality of nodes 106 that are assembled with each other, thereby forming the frame 102. The frame 102 has a square shape, but can be of any closed-shape (e.g., rectangle, circle, triangle, pentagon, octagon, D-shape) or any open-shape (e.g., U-shape, C-shape, J-shape), each whether symmetrical or asymmetrical. For example, the frame 102 can be configured to support an equipment item thereon, which can thereby be above a ground surface (e.g., within about 1, 2, 3, 4, 5, or more inches). For example, the equipment item can be an electrical transformer configured for an outdoor use, an HVAC condenser unit configured for an outdoor use, a stand-by electrical generator configured for an outdoor use, a water pump configured for an outdoor use, or others.

The tubular members 104 have solid sidewalls, although perforated sidewalls are possible. The tubular members 104 have square cross-sections, but can be of any closed-shape (e.g., rectangle, circle, triangle, pentagon, octagon, D-shape) or any open-shape (e.g., U-shape, C-shape, J-shape), each whether symmetrical or asymmetrical. The tubular members 104 (or the nodes 106) are internally hollow, but the tubular members 104 (or the nodes 106) can be internally hollow and filled with a volume of matter (other than ambient air) to add weight (e.g., concrete, gel, foam, particulates, sand, beads). For example, the volume of matter can include a gelling formulation for subsequent mixing with water (e.g., at installation site) in order to harden the gel and add weight/bulk. For example, the gel can include a super absorbent polymer (SAP), such at least one of sodium polyacrylate, sodium polycarbonate, polyacrylamide copolymers, ethylene maleic anhydride, carboxymethylcellulose, polyvinyl alcohol copolymers, or polyethylene oxide, which may not expand upon freezing, thereby allowing the tubular members 104 to be filled with water.

The tubular members 104 are configured to telescope (e.g., freely, snugly) with each other between the nodes 106 in order to control how the frame 102 is sized or shaped, which can be useful to accommodate for various makes and models of equipment items that can vary in size or shape. For example, various makes and models of outdoor HVAC condenser units, electrical transformers, water pumps, or other equipment items can vary in size or shape. However, note that the tubular members 104 can avoid telescoping with each other and instead be fastened, adhered, magnetized, interlocked, or bracketed to each other. Alternatively or additionally, at least one side of the frame 102 can have a single tubular member 104.

The tubular members 104 define a plurality of openings 138 (see FIG. 2), but can lack the openings 138 as well. For example, for a respective tubular member 104, at least one end portion thereof can host a pair of opposing openings 138, which can be diametrically or diagonally opposing each other. The tubular members 104 are longitudinally rectilinear, but can be non-rectilinear (e.g., arcuate, sinusoidal). The tubular members 104 have a cross-section that has a square shape, but can be of any closed-shape (e.g., square, rectangle, circle, triangle, pentagon, octagon, D-shape) or any open-shape (e.g., U-shape, C-shape, J-shape), whether used in an upside or inverted manner. The tubular members 104 include metal (e.g., aluminum, copper, titanium, iron) or metal alloys (e.g., stainless steel, brass), but can include non-metals (e.g., plastic, rubber, fabric). The tubular members 104 are configured to support an equipment item thereon, as disclosed herein. For example, when the equipment item is an HVAC condenser configured for an outdoor use, a water pump configured for an outdoor use, an electrical transformer configured for an outdoor use, an stand-by electrical generator configured for an outdoor use, or another equipment item configured for an outdoor use, then the tubular members 104 can be configured for an outdoor use (e.g., weatherproof, stainless, rustproof, ultraviolet (UV) resistant, hurricane resistant, flooding resistant, corrosion resistant, rot resistant) to support the HVAC condenser, the water pump, the electrical transformer or another equipment item in an outdoor environment (although an indoor use is possible).

Each of the nodes 106 (e.g., housings) includes a first tube 112, a second tube 114, and a third tube 116. For example, as shown in FIG. 1, the first tube 112, the second tube 114, and the third tube 116 join to form an X-Y-Z Cartesian plane, although this formation is not required. Each of the first tube 112 and the second tube 114 defines a plurality of openings 140 (see FIG. 2), but can lack the openings 140 as well. For example, for a respective first tube 112 or a respective second tube 114, at least a pair of opposing sides thereof can host a pair of opposing openings 140, which can be diametrically or diagonally opposing each other. Each of the first tube 112, the second tube 114, and the third tube 116 is longitudinally rectilinear, but can be non-rectilinear (e.g., arcuate, sinusoidal). Each of the first tube 112 and the second tube 114 has a cross-section that has a square shape, but can be of any closed-shape (e.g., square, rectangle, circle, triangle, pentagon, octagon, D-shape) or any open-shape (e.g., U-shape, C-shape, J-shape). Likewise, the third tube 116 has a cross-section that has a circular shape, but can be of any closed-shape (e.g., square, rectangle, circle, triangle, pentagon, octagon, D-shape) or any open-shape (e.g., U-shape, C-shape, J-shape). Each of the nodes 106, including at least one of the first tube 112, the second tube 114, or the third tube 116, includes metal (e.g., aluminum, copper, titanium) or metal alloys (e.g., stainless steel, brass), but can include non-metals (e.g., plastic, rubber, fabric). Each of the nodes 106, including the first tube 112, the second tube 114, and the third tube 116, is configured to support an equipment item thereon, as disclosed herein. For example, when the equipment item is an HVAC condenser configured for an outdoor use, a water pump configured for an outdoor use, an electrical transformer configured for an outdoor use, an stand-by electrical generator configured for an outdoor use, or another equipment item configured for an outdoor use, then each of the nodes 106, including the first tube 112, the second tube 114, and the third tube 116, can be configured for an outdoor use (e.g., weatherproof, stainless, rustproof, ultraviolet (UV) resistant, hurricane resistant, flooding resistant, corrosion resistant, rot resistant) to support the HVAC condenser, the water pump, the electrical transformer, the stand-by electrical generator, or another equipment item in an outdoor environment (although an indoor use is possible).

The first tube 112, the second tube 114, and the third tube 116 are in an L-shape configuration with respect to each other. For example, as shown in FIG. 1, the first tube 112, the second tube 114, and the third tube 116 join to form an X-Y-Z Cartesian plane, although this formation is not required. However, note that this L-shape configuration can vary with respect to at least two of the first tube 112, the second tube 114, and the third tube 116. For example, the first tube 112 and the second tube 114 are not in the L-shape configuration (e.g., acutely angled or obtusely angled) with respect to each other, but the third tube 116 is in the L-shape configuration with respect to at least one of the first tube 112 or the second tube 114.

The first tube 112 and the second tube 114 are configured to receive (or otherwise engage with or attach to) the tubular members 104, without the tubular members 104 contacting each other within that respective node 106 (although such contact is possible). The third tube 116 extends between the first tube 112 and the second tube 114. The third tube 116 is configured to contain (or otherwise host) a respective auger 108. As such, one of the tubular members 104 can be inserted into the first tube 112 such that the first tube 112 receives that respective tubular member 104, without that respective tubular member 104 contacting that respective auger 108 (although this contact is possible). Likewise, another of the tubular members 104 can be inserted into the second tube 114 such that the second tube 114 receives that respective tubular member 104, without that respective tubular member 104 contacting that respective auger 108 (although this contact is possible). Further, one of the tubular members 104 inserted into the first tube 112 and another of the tubular members 104 inserted into the second tube 114 may avoid contacting each other, while that respective auger 108 extends through the third tube 116 (although this contact is possible). Cumulatively, this configuration enables the frame 102 to be assembled via the tubular members 104 and the nodes 106. Note that the nodes 106 can be absent and the tubular members 104 can secure (e.g., fasten, mate, bracket) to each other, without the nodes 106. Further, the frame 102 can include at least one intermediary connection piece (e.g., bracket, housing) between the nodes 106. Although FIG. 1 shows each of the first tube 112 and the second tube 114 receiving a respective tubular member 104, note that a vice versa configuration is possible. For example, the respective tubular member 104 can receive one of the first tube 112 or the second tube 114.

For each of the nodes 106, the first tube 112, the second tube 114, and the third tube 116 are not parallel with each other (although parallel orientation is possible). For example, as shown in FIG. 1, the first tube 112, the second tube 114, and the third tube 116 join to form an X-Y-Z Cartesian plane, although this formation is not required. Likewise, the first tube 112 and the second tube 114 are perpendicular to each other (although non-perpendicular or acute or obtuse orientation is possible). Similarly, the third tube 116 is perpendicular to at least one of the first tube 112 or the second tube 114 (although non-perpendicular or acute or obtuse orientation is possible).

For each of the first tube 112 and the second tube 114, there is a line 118 having a first end portion and a second end portion. The line 118 can be a bracket, a tether, a cable, a chain, a cord, a rope, or others, which can be braided. The line 118 can be rigid (e.g., incapable of being manually bent) or non-rigid (e.g., capable of being manually bent, flexible, elastic, resilient). The line 118 includes metal (e.g., aluminum, copper, titanium) or metal alloys (e.g., stainless steel, brass), but can include non-metals (e.g., plastic, rubber, fabric). The line 118 can be configured for an outdoor use (e.g., weatherproof, stainless, rustproof, ultraviolet (UV) resistant, hurricane resistant, flooding resistant, corrosion resistant, rot resistant). However, note that the line 118 can also be used in an indoor use.

Likewise, for each of the first tube 112 and the second tube 114, there is a pin 120 having a first end portion and a second end portion. For example, the pin 120 can include a bolt with a head and a threaded portion opposite therefrom, a bolt with a first threaded portion and a second threaded portion opposite therefrom. The pin 120 can be rigid (e.g., incapable of being manually bent) or non-rigid (e.g., capable of being manually bent, flexible, elastic, resilient), whether longitudinally rectilinear or longitudinally non-rectilinear (e.g., arcuate, sinusoidal). The pin 120 includes metal (e.g., aluminum, copper, titanium) or metal alloys (e.g., stainless steel, brass), but can include non-metals (e.g., plastic, rubber, fabric). The pin 120 is configured for an outdoor use (e.g., weatherproof, stainless, rustproof, ultraviolet (UV) resistant, hurricane resistant, flooding resistant, corrosion resistant, rot resistant). However, note that the pin 120 can also be used in an indoor use.

When the openings 138 and the openings 140 are co-aligned, whether diametrically or diagonally, based on a respective tubular member 104 being inserted into a respective node 106 (or vice versa), the pin 120 extends through the openings 138 and the openings 140 in order to secure the respective node 106, whether via the first tube 112 or the second tube 114, to the respective tubular member 104. Therefore, the pin 120 extends simultaneously through that respective node 106, whether through the first tube 112 or through the second tube 114, via the openings 140 and one of the tubular members 104 inserted into that respective node 106, whether into the first tube 112 or the second tube 114, via the openings 138. The pin 120 extends through the respective node 106 via the openings 140 and the respective tubular member 104 via the openings 138 between the first end portion of the pin 120 and the second end portion of the pin 120. As such, the frame 102 can support an equipment item thereon when the respective tubular member 104 is secured to that respective node 106. The line 118 spans between the first end portion of the pin 120 (e.g., a head thereof) and the second portion of the pin 120 (e.g., a tail thereof) external to that respective node 106 when the frame 102 supports an equipment item, as disclosed herein. For example, the first end portion of the line 118 is secured to, loops about, lassoed around, braided about, or contacts with the first end portion of the pin 120 external to that respective node 106 and the second portion of the line 118 is secured to, loops about, lassoed around, braided about, or contacts with the second end portion of the pin 120 external to the respective node 106. For example, as shown in FIG. 1, for each of the nodes 106, the line 118 has a U-shape external to those nodes 106. For example, the first end portion of the line 118 can be mounted (e.g., fastened, mated, looped, lassoed, adhered, molded) onto the first end portion of the pin 120 (e.g., a head thereof) and the second end portion of the line 118 can be mounted (e.g., fastened, mated, looped, lassoed, adhered, molded) onto the second end portion of the pin 120 (e.g., a tail thereof). As such, the nodes 106 are secured (e.g., fastened, interlocked, mated) to the tubular members 104.

The frame 102 is secured to a ground (e.g., soil, sand, rocks) via the augers 108. The augers 108 are driven, whether manually or automatically, through the nodes 106 into the ground such that the frame 102 is secured to the ground when the frame 102 supports an equipment item, as disclosed herein. For example, the augers 108 can be driven via a screwdriver, a drill, an impact driver, a wrench, a plier, or other tools, whether manually powered or powered via mains electricity, batteries, pneumatics, hydraulics, or others, whether stationary or portable, whether driven serially or in parallel.

Each of the augers 108 includes a head portion 122, a shaft 124, and plurality of flightings 126. The head portion 122 is secured to the shaft 124. The shaft 124 hosts the flightings 126. The head portion 122 and the flightings 126 oppose each other on the shaft 124. At least two of the head portion 122, the shaft 124, or at least one of the flightings 126 can be monolithic with each other (e.g., formed from a same material as one piece) or be assembled with each other (e.g., fastened, interlocked, mated, adhered).

The head portion 122 is used to interface or engage with a tool for driving that respective auger 108 (e.g., a screwdriver, a drill impact driver, a wrench, a plier, a ratchet) when securing that respective node 106 or the frame 102 to the ground (or non-securing or removal therefrom). For example, the tool may be a portable electric drill having a chuck hosting a removable bit that engages or interfaces with the head portion 122 to drive the head portion 122, whether clockwise or counterclockwise, which can enable a respective auger 108 to be inserted into a respective node 106 and the ground or to be removed from the ground and the respective node 106. The head portion 122 is pentagonal, but can be non-pentagonal (e.g. circular, hexagon, square, rectangle, triangle, oval).

The shaft 124 includes a first end portion and a second end portion. The shaft 124 is rectilinear, but can be non-rectilinear (e.g., arcuate, sinusoidal, helical, spiral). The shaft 124 is internally hollow, but can be internally solid. The shaft 124 is rigid (e.g., incapable of being manually bent), can be non-rigid (e.g., capable of being manually bent, flexible, elastic, resilient). The shaft 124 hosts a washer, whether integrated therewith or mounted thereonto, between the first end portion and the second end portion. The washer is circular, but can be non-circular (e.g., square, rectangle, pentagon, hexagon, oval, triangle). As shown in FIG. 1, the washer is circular and integrated with the shaft 124 and immediately adjacent to the head portion 122 (although non-adjacent positioning is possible). Note that the washer can be omitted as well.

The shaft 124 extends through a respective node 106 through the third tube 116, between the first tube 112 and the second tube 114, without extending through the first tube 112 or the second tube 114 (although such extension is possible) or contacting the tubular members 104 (although such contact is possible). If the washer is present, then the washer may contact the respective node 106 such that the respective node 106 extends between the washer and the flightings 126 when the device 100 supports an equipment item, as disclosed herein. The first end portion of the shaft 124 hosts the head portion 122. The shaft 124 hosts the flightings 126 distal to the respective node 106 when the device 100 supports an equipment item, as disclosed herein. The second end portion is distal to the respective node 106 when the device 100 supports an equipment item, as disclosed herein. The flightings 126 are positioned between the first end portion of the shaft 124 and the second end portion of the shaft 124. However, the flightings 126 can be positioned at the second end portion of the shaft 124. Although the flightings 126 avoid horizontally extending past the node 106 when the device 100 supports an equipment item, as disclosed herein, the flightings 126 can horizontally extend past the node 106. The second end portion is open and beveled, but can be closed or non-beveled. The flightings 126 are C-shaped, but can be shaped differently (e.g., U-shaped, O-shaped).

For each of the augers 108, at least one of the head portion 122, the shaft 124, at least one of the flightings 126, or the washer includes metal (e.g., aluminum, copper, titanium) or metal alloys (e.g., stainless steel, brass), but can include non-metals (e.g., plastic, rubber, fabric). Each of the augers 108, including at least one of the head portion 122, the shaft 124, at least one of the flightings 126, or the washer, is configured for an outdoor use (e.g., weatherproof, stainless, rustproof, ultraviolet (UV) resistant, hurricane resistant, flooding resistant, corrosion resistant, rot resistant). However, each of the augers 108, including at least one of the head portion 112, the shaft 124, at least one of the flightings 126, or the washer, can be configured for an indoor use as well.

The brackets 110 are configured to secure an equipment item to the frame 102 via the tubular members 104. These points of securement can be between the nodes 106. As shown in FIG. 1, each of the brackets 110 is J-shaped as defined via a hook portion 132 (e.g., a U-shape) and a column portion 130 (e.g., an I-shape). The hook portion 132 includes a plurality of sides that oppose each other, where at least one of the tubular members 104 longitudinally extends between the sides, while extending between the nodes 106. The column portion 130 defines a plurality of openings 134 through which the column portion 130 is configured to be fastened (e.g., screws, bolts) to an equipment item above the frame 102 when the frame 102 supports an equipment item, as disclosed herein. Also, the column portion 130 or the hook portion 132 defines an opening 136 through which the column portion 130 or the hook portion 132 is configured to be fastened (e.g., screws, bolts) to at least one of the tubular members 104 between the nodes 106. As such, the brackets 110 are configured to grasp the frame 102 via the tubular members 104 (although via the nodes 106 is possible) and to be fastened to an equipment item above the frame 102 when the frame 102 supports an equipment item, as disclosed herein. Note that although the brackets 110 are J-shaped, the brackets 110 can be shaped differently (e.g., C-shaped, U-shaped, L-shaped). Further, note that the brackets 110 can be absent as well and an equipment item secures to the frame 102 in non-bracketing ways (e.g., mating, adhering, magnetizing, suction-cupping).

Figure 2:
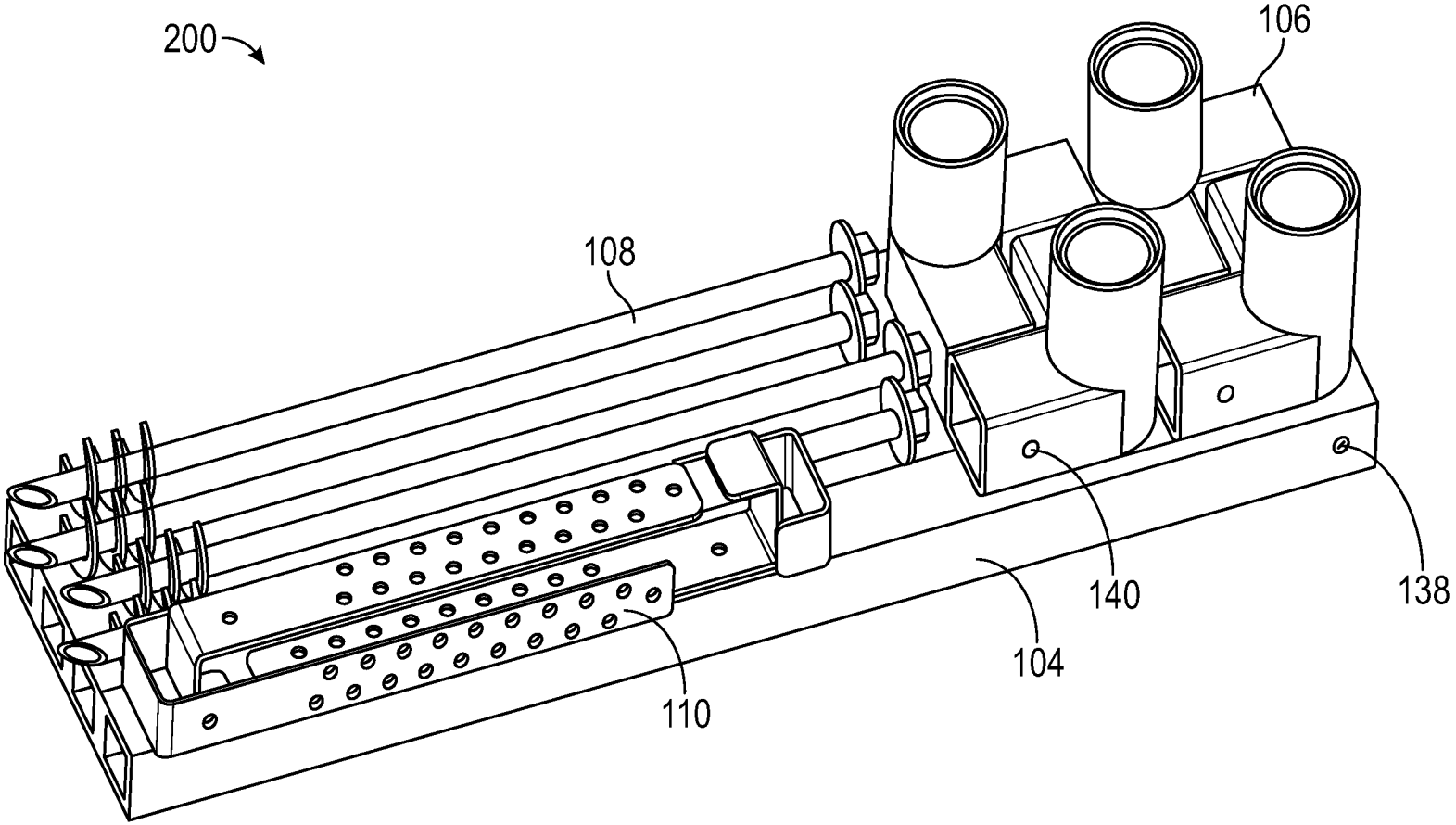
FIG. 2 shows an embodiment of a kit for supporting an equipment item according to this disclosure.

FIG. 2 shows an embodiment of a kit for supporting an equipment item according to this disclosure. In particular, a kit 200 includes the tubular members 104, the nodes 106, the augers 108, and the brackets 110. Note that the nodes 106 can positionally interface with each other, in a jigsaw puzzle like manner. Further, the nodes 106 can magnetically or matingly or interlockably (or otherwise) couple to each other. Further, the tubular members 104 can magnetically or interlockably or matingly (or otherwise) couple to the nodes 106, the augers 108, the brackets 110, or each other.

The kit 200 can be packaged in a container (e.g. paper or plastic envelope, paper or plastic bag, sealed bag, storage container, cardboard box, transport package, consumer package, bubble wrap, foam blanket, garment blanket, can, shrink-wrap, molded pulp, blister pack, intermodal container). For example, the container can include a cuboid box, a shipping box, an intermodal container, or others suitable for transit. The container can include one or more devices, as disclosed herein or not disclosed herein. Note that container-within-container is possible. For example, the kit 200 can be placed within a box, which may be placed within an intermodal container.

Figure 3:
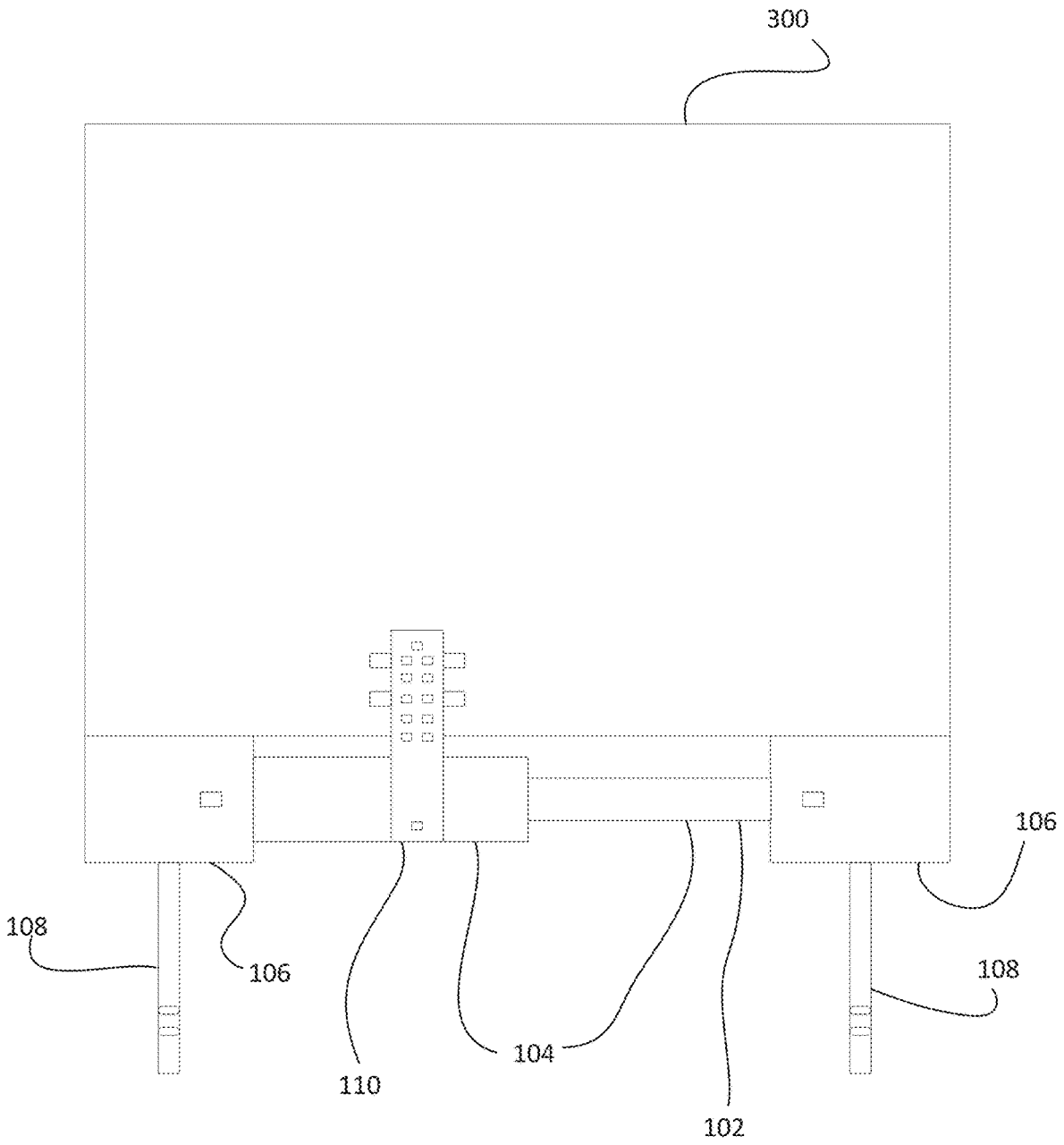
FIG. 3 shows an embodiment of a device supporting an outdoor HVAC condenser unit according to this disclosure.

FIG. 3 shows an embodiment of a device supporting an outdoor HVAC condenser unit according to this disclosure. In particular, an outdoor HVAC condenser unit 300 is supported on the device 100 via the frame 102 being secured to the ground via the augers 108. During such support, the nodes 106 contact the outdoor HVAC condenser unit 300 (although such contact can be avoided) and the tubular members 104 avoid contact with the outdoor HVAC condenser unit 300 (although such contact is possible). For example, during such support, the tubular members 104 can contact the outdoor HVAC condenser unit or the nodes 106 can avoid contact with the outdoor HVAC condenser unit 300. Further, the outdoor HVAC condenser unit 300 can magnetically or interlockably or matingly (or otherwise) couple to the device 100, whether via the nodes 106 or the tubular members 104. As such, for example, when the frame 102 is used to support the outdoor HVAC condenser unit 300 in high velocity wind zones (e.g., Florida), the frame 102 supporting the outdoor HVAC condenser unit 300 can be hurricane resistant for winds of 200 miles per hour (mph) (or less or more) or exceed Miami-Dade 175 mph wind requirements (although non-exceeding is possible). Since the outdoor HVAC condenser 300 may come in different weights, the device 100 can be manufactured in different configurations to respectively support such weights or there can be a single version that supports most or all of such weights. For example, these weights can range from about 50 pounds to about 1,500 pounds, although higher or lower weights are possible. Note that although FIG. 3 is shows the outdoor HVAC condenser unit, other equipment items, whether indoor or outdoor, can be supported on the device 100. For example, the device 100 can support an electrical transformer configured for an outdoor use, a stand-by electrical generator configured for an outdoor use, a water pump configured for an outdoor use, or any other outdoor equipment item (although indoor equipment items are possible).

As explained above, a method can include: causing a plurality of tubular members 104 and a plurality of nodes 106 to be assembled into a frame 102; causing a plurality of augers 108 to be driven through the nodes 106 into a ground as the frame 102 rests on the ground such that the frame 102 is secured to the ground; and causing an equipment item 300 to be positioned on the frame 102 after the frame 102 is secured to the ground such that the frame 102 extends between the equipment item 300 and the ground. The method can include causing a plurality of brackets 110 to grasp the tubular members 104 between the nodes 106 before the equipment item 300 is positioned on the frame 102 (although during or after is possible as well); and causing the brackets 110 to be fastened to the equipment item 300 after the equipment item 300 is positioned on the frame 102. The method can include causing the equipment item 300 positioned on the frame 102 to be exposed to a hurricane (or another high wind weather event) after the brackets 110 grasp the tubular members 104 between the nodes 106 and after the brackets 110 are fastened to the equipment item 300.

Figure 4:
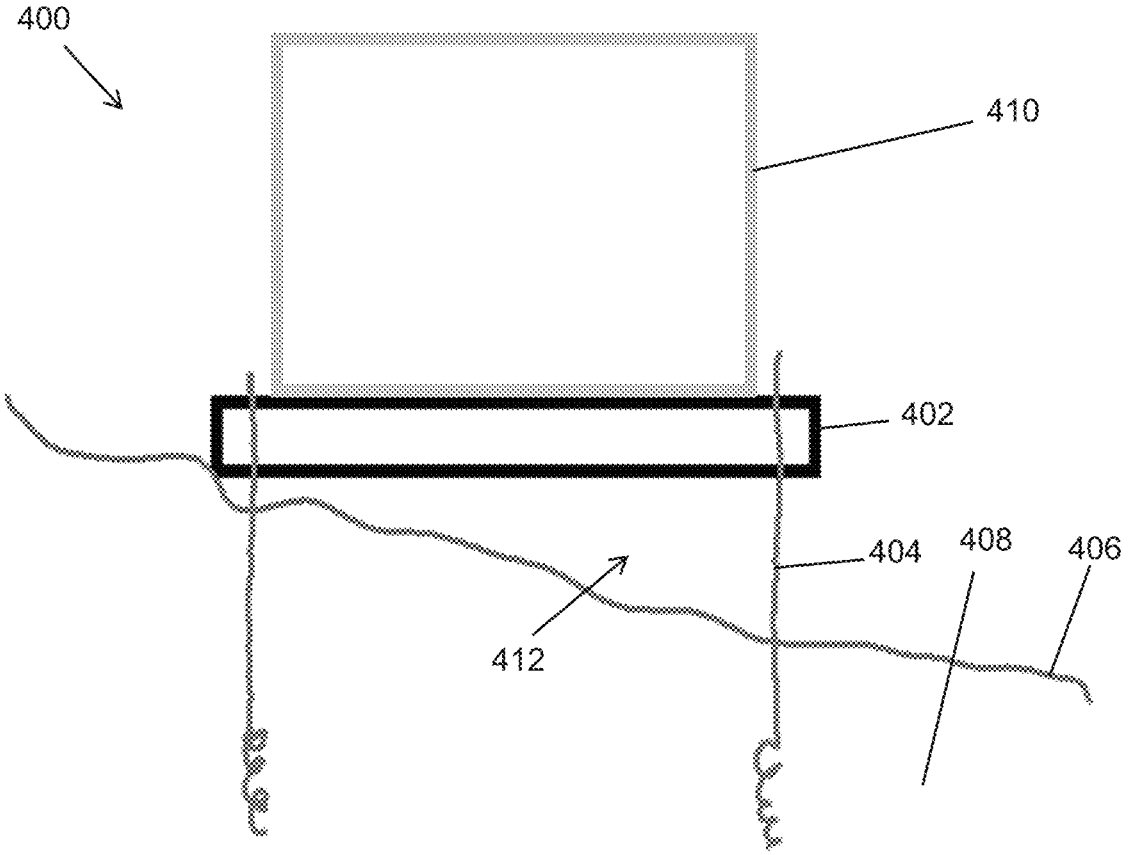
FIG. 4 shows an embodiment of a device for supporting an equipment item according to this disclosure.

FIG. 4 shows an embodiment of a device for supporting an equipment item according to this disclosure. In particular, whether in a high velocity wind zone or a non-high velocity wind zone, whether outdoors or indoors, the device 100 can also be used as a leveling device 400 or vice versa. The leveling device 400 can be configured as the device 100 or vice versa. The device 400 includes a frame 402 and a plurality of augers 404. The frame 402 can be configured as the frame 102 or vice versa. The augers 404 can be configured as the augers 108 or vice versa. The augers 404 can include a first auger 404 and a second auger 404.

The leveling device 400 can be used to support an equipment item 410 (e.g., an HVAC condenser unit, an electrical transformer, a stand-by electrical generator, a water pump) in a level manner when a ground surface 406 is inclined or not generally level, whether positively or negatively, whether indoors or outdoors. As such, the first auger 404 can be driven through the frame 402 (e.g., a node 106, a tubular member 104) into a ground 408 (e.g., soil, rocks, sand), past the ground surface 406, such that (a) the frame 402 rests, which can include contact, on the ground surface 406 and (b) the frame 402 is secured to the ground 408 via the first auger 404, as described herein. The second auger 404 can be driven through the frame 402 (e.g., a node 106, a tubular member 104) into the ground 408 such that (a) the frame 402 is raised over the ground surface 406 thereby forming an air gap 412 between the frame 402 and the ground surface 406 and (b) the frame 402 is secured to the ground 408 via the second auger 404. Therefore, the equipment item 410 can be positioned on the frame 402, whether before, during, or after the first auger 404 or the second auger 404 are driven through the frame 402 into the ground 408, such that the frame 402 extends (a) between the equipment item 410 and the ground surface 406 and (b) between the equipment item 410 and the air gap 412. Resultantly, the leveling device 400 enables the equipment item 410 to be supported in the level manner since the first auger 404 and the second auger 404 can be driven to same or different depths in the ground and still support weight of the equipment item 410, as shown in FIG. 4.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow.

Accordingly, such modifications and variations are contemplated as being a part of this disclosure. Scope of this disclosure is defined by various claims, which include known equivalents and unforeseeable equivalents at a time of filing of this disclosure.

What is claimed is:

1. A device comprising:

a plurality of tubular members;

a plurality of nodes configured to be assembled with the tubular members and thereby form a frame configured to support an outdoor equipment item; and a plurality of augers configured to be driven through the nodes into a ground such that the frame is secured to the ground when the frame supports the outdoor equipment item, wherein the tubular members include a first tubular member and a second tubular member, wherein at least one of the nodes includes a housing that has (i) the first tubular member extending therefrom along a first direction, (ii) the second tubular member extending therefrom along a second direction different from the first direction, and (iii) at least one of the augers extending through the housing along a third direction different from the first direction and the second direction.

2. The device of claim 1, further comprising:

a plurality of brackets configured to grasp the frame and to be secured to the outdoor equipment item above the frame when the frame supports the outdoor equipment item.

3. The device of claim 2, wherein at least one of the brackets is J-shaped as defined via a hook portion and a column portion, wherein the hook portion includes a plurality of sides that oppose each other, wherein at least one of the tubular members is configured to longitudinally extend between the sides when the frame supports the outdoor equipment item, wherein the column portion is configured to be secured to the outdoor equipment item above the frame between the nodes when the frame supports the outdoor equipment item.

4. The device of claim 1, wherein the tubular members include a third tubular member, wherein at least one of the first tubular member or the second tubular member is telescopable with the third tubular member such that the frame changes at least one of a shape thereof or a size thereof.

5. The device of claim 1, wherein the at least one of the nodes includes a first tube, a second tube, and a third tube, wherein the first tube is configured to engage with the first tubular member when the frame is formed, wherein the second tube is configured to engage with the second tubular member when the frame is formed, wherein the third tube is configured to contain the at least one of the augers when the frame supports the outdoor equipment item.

6. The device of claim 5, wherein the first tube, the second tube, and the third tube are not parallel with each other.

7. The device of claim 6, wherein the first tube and the second tube are generally perpendicular to each other.

8. The device of claim 6, wherein the third tube is generally perpendicular to at least one of the first tube or the second tube.

9. The device of claim 1, further comprising:

a line; and a pin including a first end portion and a second end portion, wherein the pin is configured to extend simultaneously into the at least one of the nodes and at least one of the first tubular member or the second tubular member when the frame supports the outdoor equipment item, wherein the line is configured to span between the first end portion and the second end portion external to the at least one of the nodes when the frame supports the outdoor equipment item.

10. The device of claim 1, wherein the frame has a closed-shape when the frame supports the outdoor equipment item.

11. The device of claim 1, wherein the at least one of the augers includes a head portion, a shaft, and a plurality of flightings, wherein the shaft includes a first end portion and a second end portion, wherein the shaft extends through the at least one of the nodes when the frame supports the outdoor equipment item, wherein the first end portion hosts the head portion, wherein the shaft hosts the flightings distal to the at least one of the nodes when the frame supports the outdoor equipment item, wherein the second end portion is distal to the at least one of the nodes when the frame supports the outdoor equipment item.

12. The device of claim 1, wherein the at least one of the augers is configured to be driven through the at least one of the nodes into the ground without extending through at least one of the first tubular member or the second tubular member.

13. The device of claim 1, wherein the at least one of the augers is configured to extend through the at least one of the nodes between the first tubular member and the second tubular member.

14. The device of claim 1, wherein the outdoor equipment item is a stand-by electrical generator or a condenser unit.

15. The device of claim 1, wherein the ground is inclined or not generally level between at least two of the augers.

16. A method comprising:

causing a user to assemble a plurality of tubular members and a plurality of nodes into a frame;

causing the user to drive a plurality of augers through the nodes into a ground as the frame rests on the ground such that the frame is secured to the ground; and causing the user to position an outdoor equipment item on the frame after the frame is secured to the ground such that the frame extends between the outdoor equipment item and the ground, wherein the tubular members include a first tubular member and a second tubular member, wherein at least one of the nodes includes a housing that (i) has the first tubular member extending therefrom along a first direction, (ii) the second tubular member extending therefrom along a second direction different from the first direction, and (iii) at least one of the augers extending through the housing along a third direction different from the first direction and the second direction.

17. The method of claim 16, wherein the frame is telescopically adjustable in at least one of a shape thereof or a size thereof.

18. The method of claim 16, further comprising:

causing the user to operate a plurality of brackets to grasp the tubular members between the nodes; and causing the user to secure the brackets to the outdoor equipment item positioned on the frame.

19. The method of claim 18, further comprising:

causing the user to expose the outdoor equipment item positioned on the frame to a hurricane after the brackets grasp the tubular members between the nodes and after the brackets are secured to the outdoor equipment item such that the frame remains secured to the ground as the frame supports the outdoor equipment item and the outdoor equipment item is secured to the frame via the brackets.

20. The method of claim 16, wherein the outdoor equipment item is a stand-by electrical generator or a condenser unit.

21. The method of claim 16, further comprising:

causing the user to couple a line and a pin including a first end portion and a second end portion to the frame such that (a) the pin extends simultaneously into the at least one of the nodes and at least one of the first tubular member or the second tubular member as the frame supports the outdoor equipment item and (b) the line spans between the first end portion and the second end portion external to the at least one of the nodes as the frame supports the outdoor equipment item.

22. The method of claim 16, wherein the at least one of the augers is driven through the at least one of the nodes into the ground without extending through at least one of the first tubular member or the second tubular member.

23. The method of claim 16, wherein the at least one of the augers extends through the at least one of the nodes between the first tubular member and the second tubular member.

24. The method of claim 16, wherein the ground is inclined or not generally level between at least two of the augers.

25. A kit comprising:

a container;

a plurality of tubular members contained in the container;

a plurality of nodes contained in the container, wherein the nodes are configured to be assembled with the tubular members and thereby form a frame configured to support an outdoor equipment item thereon;

a plurality of augers contained in the container, wherein the augers are configured to be driven through the nodes into a ground such that the frame is secured to the ground when the frame (a) supports the outdoor equipment item and (b) extends between the outdoor equipment item and the ground, wherein the tubular members include a first tubular member and a second tubular member, wherein at least one of the nodes includes a housing that has (i) the first tubular member extending therefrom along a first direction, (ii) the second tubular member extending therefrom along a second direction different from the first direction, and (iii) at least one of the augers extending through the housing along a third direction different from the first direction and the second direction; and a plurality of brackets contained in the container, wherein the brackets are configured to grasp the frame and to be secured to the outdoor equipment item above the frame when the frame (a) supports the outdoor equipment item and (b) extends between the outdoor equipment item and the ground.

26. The kit of claim 25, wherein the outdoor equipment item is a stand-by electrical generator or a condenser unit.

27. The kit of claim 25, wherein the frame is telescopically adjustable such that the frame changes at least one of a shape thereof or a size thereof.

28. The kit of claim 25, further comprising:

a line contained in the container; and a pin contained in the container, wherein the pin includes a first end portion and a second end portion, wherein the pin is configured to extend simultaneously into the at least one of the nodes and at least one of the first tubular member or the second tubular member when the frame supports the outdoor equipment item, wherein the line is configured to span between the first end portion and the second end portion external to the at least one of the nodes when the frame supports the outdoor equipment item.

29. The kit of claim 25, wherein the at least one of the augers is configured to be driven through the at least one of the nodes into the ground without extending through at least one of the first tubular member or the second tubular member.

30. The kit of claim 25, wherein the at least one of the augers is configured to extend through the at least one of the nodes between the first tubular member and the second tubular member.

31. The kit of claim 25, wherein the ground is inclined or not generally level between at least two of the augers.

32. A method comprising:

causing a user to drive a first auger through a first housing of a frame into a ground such that the frame (a) rests on the ground and (b) is secured to the ground via the first auger;

causing the user to drive a second auger through a second housing of the frame into the ground such that the frame (a) is raised over the ground thereby forming an air gap between the frame and the ground and (b) is secured to the ground via the second auger, wherein the ground is inclined or not generally level between the first auger and the second auger such that the second auger is more exposed to the air gap than the first auger, wherein frame includes a tubular member spanning between the first housing and the second housing; and causing the user to position an equipment item on the frame while the ground is inclined or not generally level between the first auger and the second auger and the second auger is more exposed to the air gap than the first auger such that the frame extends (a) between the equipment item and the ground and (b) between the equipment item and the air gap.

33. The method of claim 32, wherein the equipment item is a stand-by electrical generator or a condenser unit.

34. The method of claim 32, wherein the frame is telescopically adjustable such that the frame changes at least one of a shape thereof or a size thereof.

35. The method of claim 32, further comprising:

causing the user to couple a line and a pin including a first end portion and a second end portion to the frame such that the pin extends into the frame as the frame supports the equipment item, wherein the line spans between the first end portion and the second end portion external to the frame as the frame supports the equipment item.

36. A method comprising:

causing a user to position an outdoor equipment item on a frame (1) assembled from a plurality of tubular members and a plurality of nodes and (2) having a plurality of augers extending through the nodes into a ground as the frame rests on the ground such that the frame is secured to the ground and the frame extends between the outdoor equipment item and the ground, wherein the tubular members include a first tubular member and a second tubular member, wherein at least one of the nodes includes a housing that has (i) the first tubular member extending therefrom along a first direction, (ii) the second tubular member extending therefrom along a second direction different from the first direction, and (iii) at least one of the augers extending through the housing along a third direction different from the first direction and the second direction; and causing the user to allow the outdoor equipment item to be operative while the outdoor equipment item rests on the frame.

37. The method of claim 36, wherein the frame is adjustable in shape or size.

38. The method of claim 37, wherein the tubular members include a third tubular member, wherein the frame is telescopically adjustable in shape or size via at least one of the first tubular member or the second tubular member engaging with the third tubular member.

39. The method of claim 36, wherein the outdoor equipment item is secured to a plurality of brackets grasping the frame.

40. The method of claim 36, wherein the outdoor equipment item is a stand-by electrical generator or a condenser unit.

41. The method of claim 36, wherein the frame includes a line and a pin including a first end portion and a second end portion such that the pin extends simultaneously into the at least one of the nodes and at least one of the first tubular member or the second tubular member as the frame supports the outdoor equipment item, wherein the line spans between the first end portion and the second end portion external to the at least one of the nodes when the frame supports the outdoor equipment item.

42. The method of claim 36, wherein the at least one of the augers extends through the at least one of the nodes into the ground without extending through at least one of the first tubular member or the second tubular member.

43. The method of claim 36, wherein the at least one of the augers extends through the at least one of the nodes between the first tubular member and the second tubular member.

44. The method of claim 36, wherein the ground is inclined or not generally level between at least two of the augers.

45. A device comprising:

a plurality of elongated members;

a plurality of housings configured to be assembled with the elongated members and thereby form a frame configured to support an outdoor equipment item; and a plurality of augers configured to be driven through the housings into a ground such that the frame is secured to the ground when the frame supports the outdoor equipment item, wherein the elongated members include a first elongated member and a second elongated member, wherein at least one of the housings has (i) the first elongated member extending therefrom along a first direction, (ii) the second elongated member extending therefrom along a second direction different from the first direction, and (iii) at least one of the augers extending through the housing along a third direction different from the first direction and the second direction, wherein the third direction is not parallel with the first direction and the second direction.

* * * * *